US009431753B2

(12) United States Patent
Wu et al.

(10) Patent No.: US 9,431,753 B2
(45) Date of Patent: Aug. 30, 2016

(54) CONNECTOR WITH CONVENIENT INSTALLATION

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/694,107

(22) Filed: Apr. 23, 2015

(65) Prior Publication Data

US 2015/0229066 A1 Aug. 13, 2015

Related U.S. Application Data

(63) Continuation-in-part of application No. 14/583,746, filed on Dec. 28, 2014.

(30) Foreign Application Priority Data

Dec. 30, 2013 (CN) ..... 2013 1 0741050
Dec. 30, 2013 (CN) ..... 2013 1 0741084
Apr. 24, 2014 (CN) ..... 2014 2 0201056 U

(51) Int. Cl.
*H01R 13/6593* (2011.01)
*H01R 13/504* (2006.01)
*H01R 27/02* (2006.01)
*H01R 24/62* (2011.01)

(52) U.S. Cl.
CPC ..... *H01R 13/504* (2013.01); *H01R 13/6593* (2013.01); *H01R 27/02* (2013.01); *H01R 24/62* (2013.01)

(58) Field of Classification Search
CPC ..... H01R 13/6593; H01R 13/504
USPC ..... 439/660, 701
See application file for complete search history.

(56) References Cited

U.S. PATENT DOCUMENTS 8,821,186 B2 * 9/2014 Lan ..... H01R 13/514 439/540.1
2010/0248552 A1 * 9/2010 He ..... H01R 27/02 439/638
2011/0034080 A1 * 2/2011 Su ..... H01R 27/00 439/607.01
2011/0250783 A1 * 10/2011 Su ..... H01R 4/2433 439/404
2014/0349523 A1 * 11/2014 Peng ..... H01R 13/6593 439/701

FOREIGN PATENT DOCUMENTS

CN 203481412 3/2014

* cited by examiner

*Primary Examiner* — Tulsidas C Patel
*Assistant Examiner* — Marcus Harcum
(74) *Attorney, Agent, or Firm* — Ming Chieh Chang; Wei Te Chung

(57) ABSTRACT

A cable end connector includes an insulative body, a number of terminals received in the insulative body, a spacer mounted behind the insulative body, and an insulative housing molded to enclose the inuslative body and the spacer. The spacer includes an intermediate chamfer at a mounting end thereof to prevent interference during mounting of the spacer to the insulative body. A stopping wall is disposed at two opposite sides of the chamfer to prevent molten plastics from flowing into the insulative body during molding the insulative housing.

13 Claims, 7 Drawing Sheets

CONNECTOR WITH CONVENIENT INSTALLATION

This application is a CIP application of the copending application Ser. No. 14/583,746 filed Dec. 28, 2014.

BACKGROUND OF THE INVENTION

1. Field of the Invention

The present invention relates to a cable end connector, and more particularly to an installation structure of the insulative body and the spacer.

2. Description of Related Arts

China Patent No. 203481412, issued on Mar. 12, 2014, discloses an electrical connector including an insulative body, a number of terminals received in the insulative body, a cable electrically connected to the corresponding terminals, a spacer assembled to the back end of the insulative body, and an insulative housing molded to enclose the insulative body and the spacer. The back end of the insulative body is designed to have a ladder shape. However, an interference will be present between the spacer and the insulative body during mounting the spacer to the insulative body, resulting in inconvenience of the installation.

An improved connector is desired to offer advantages over the related art.

SUMMARY OF THE INVENTION

An object of the present invention is to provide a cable end connector for ease of mounting of a spacer thereof.

To achieve the above-mentioned object, a cable end connector includes an insulative body, a number of terminals received in the insulative body, a spacer mounted behind the insulative body, and an insulative housing molded to enclose the inuslative body and the spacer. The spacer includes an intermediate chamfer at a mounting end thereof to prevent interference during mounting of the spacer to the insulative body. A stopping wall is disposed at two opposite sides of the chamfer to prevent molten plastics from flowing into the insulative body during molding the insulative housing.

According to the present invention, the spacer includes a chamfer to avoid the interference between the spacer and the insulative body. The stopping walls are disposed on two sides of the chamfer to prevent the molten plastic from flowing into the insulative body to influence the electrically connection of the connector.

DETAILED DESCRIPTION OF THE PREFERRED EMBODIMENT

Figure 1:
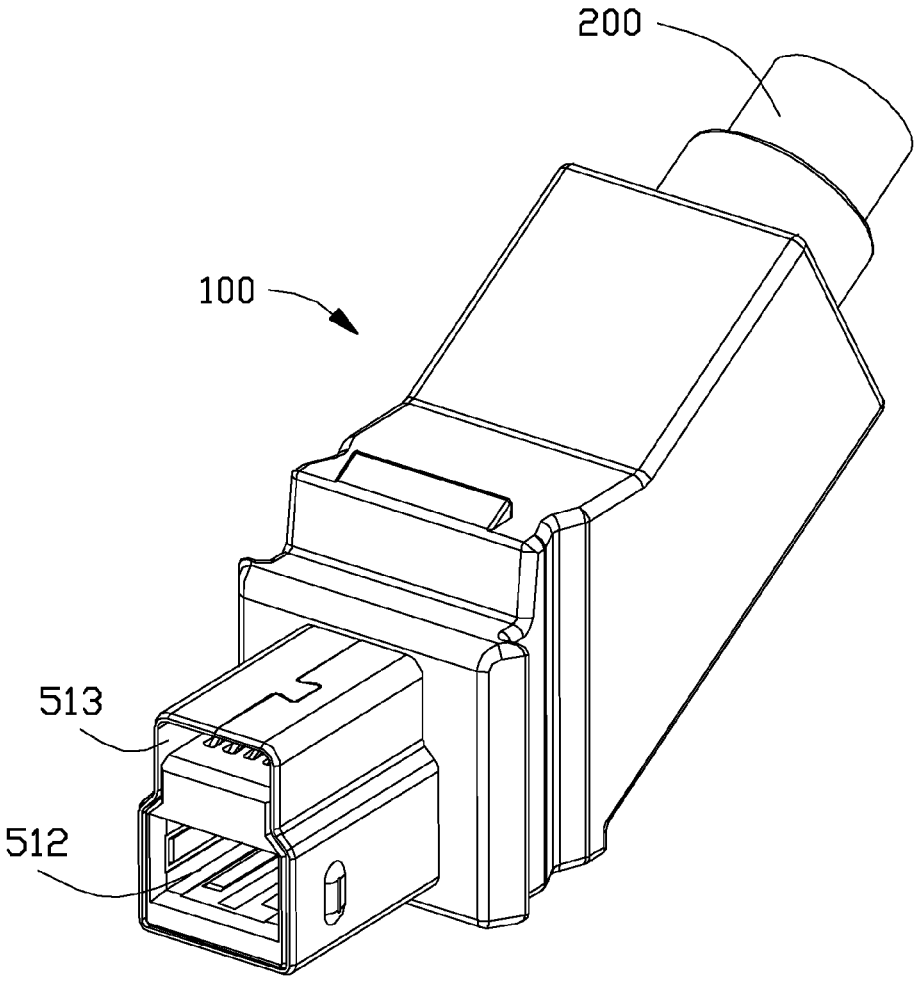
FIG. 1 is a perspective view of a cable end connector in accordance with the present invention.
Figure 2:
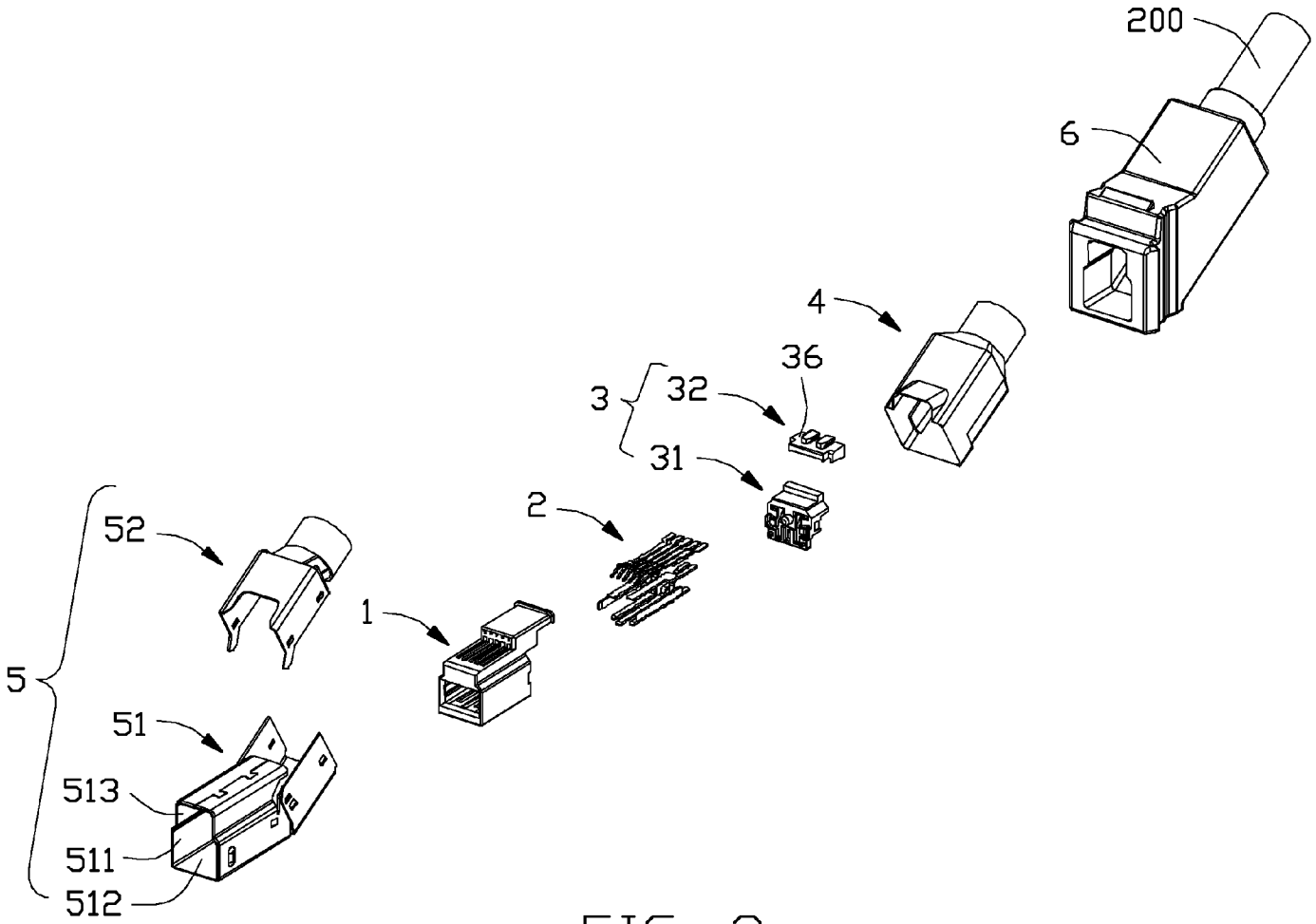
FIG. 2 is an exploded view of the connector as shown in FIG. 1.
Figure 3:
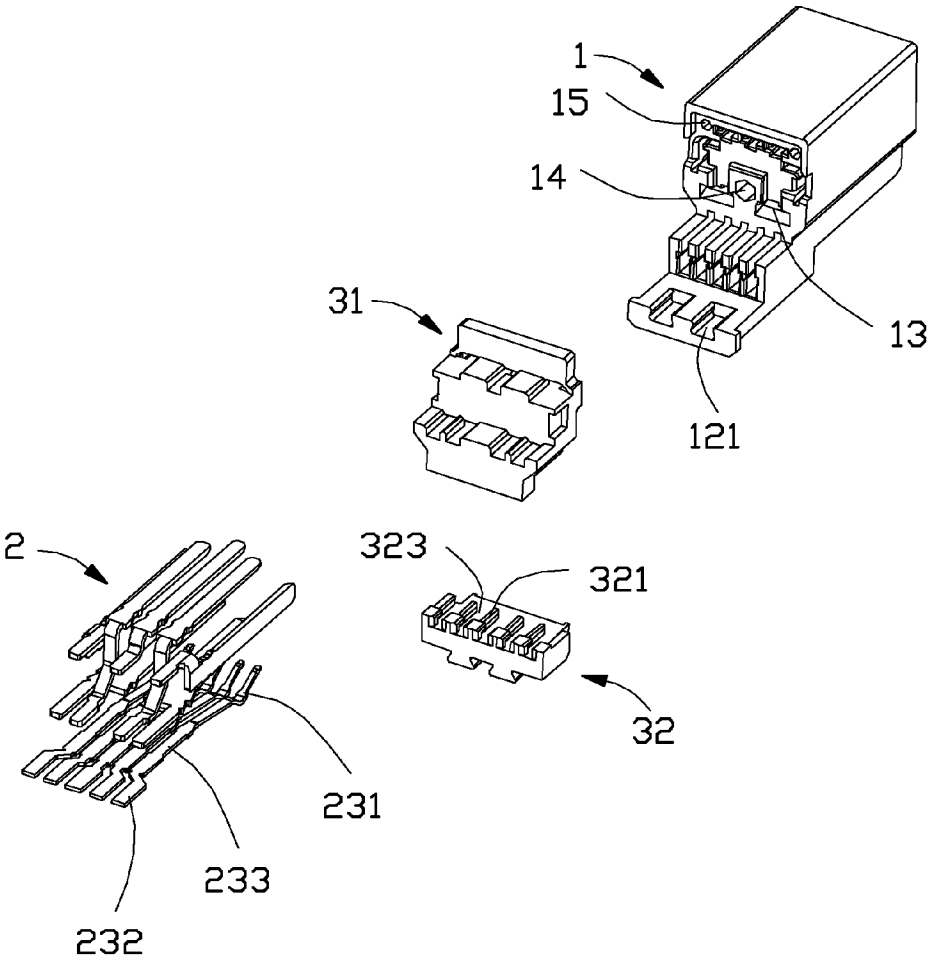
FIG. 3 is another perspective of the exploded view of the connector as shown in FIG. 1.

Reference will now be made in detail to some preferred embodiments of the present invention.

Referring to FIGS. 1 to 4, a connector 100 for soldering to a cable 200 defining a number of core wires (not shown) of this invention comprises an insulative body 1, a number of terminals 2 received in the insulative body 1, a spacer 3 mounting behind the insulative body 1, a shielding shell 4 enclosing the spacer 3, a metal shell 5 enclosing the shielding shell 4 and the insulative body 1, and an insulative housing 6 molding to the metal shell 5.

Referring to FIGS. 2 to 5, the insulative body 1 comprises a main portion 11 and an extending portion 12 extending from the main portion 11 to the cable 200. The extending portion 12 has a ladder shape. The extending portion 12 of the insulative body 1 comprises a fan slot 121. A plurality of terminal holes 13 are disposed on the insulative body 1 for being inserted by the terminals 2. A surface of the insulative body 1 which is mating with the spacer 3 comprises a first mounting hole 14 and a pair of second mounting holes 15 recessing inwardly. Two sides of the first mounting hole 14 are disposed one second mounting holes 15 respectively. The first mounting hole 14 and the second mounting holes 15 are on three points of a triangle to make the spacer 3 fixed firmly on the insulative body 1.

The terminals 2 comprise a number of first terminals 21, a number of second terminals 22, and a number of third terminals 23. Each third terminal 23 comprises a contacting portion 231 received in the insulative body 1 for mating with a mating connector, a soldering portion 232 extending out of the insulative body 1 soldering with the core wires (not shown), and a connecting portion 233 connected the contacting portion 231 and the soldering portion 232.

Figure 4:
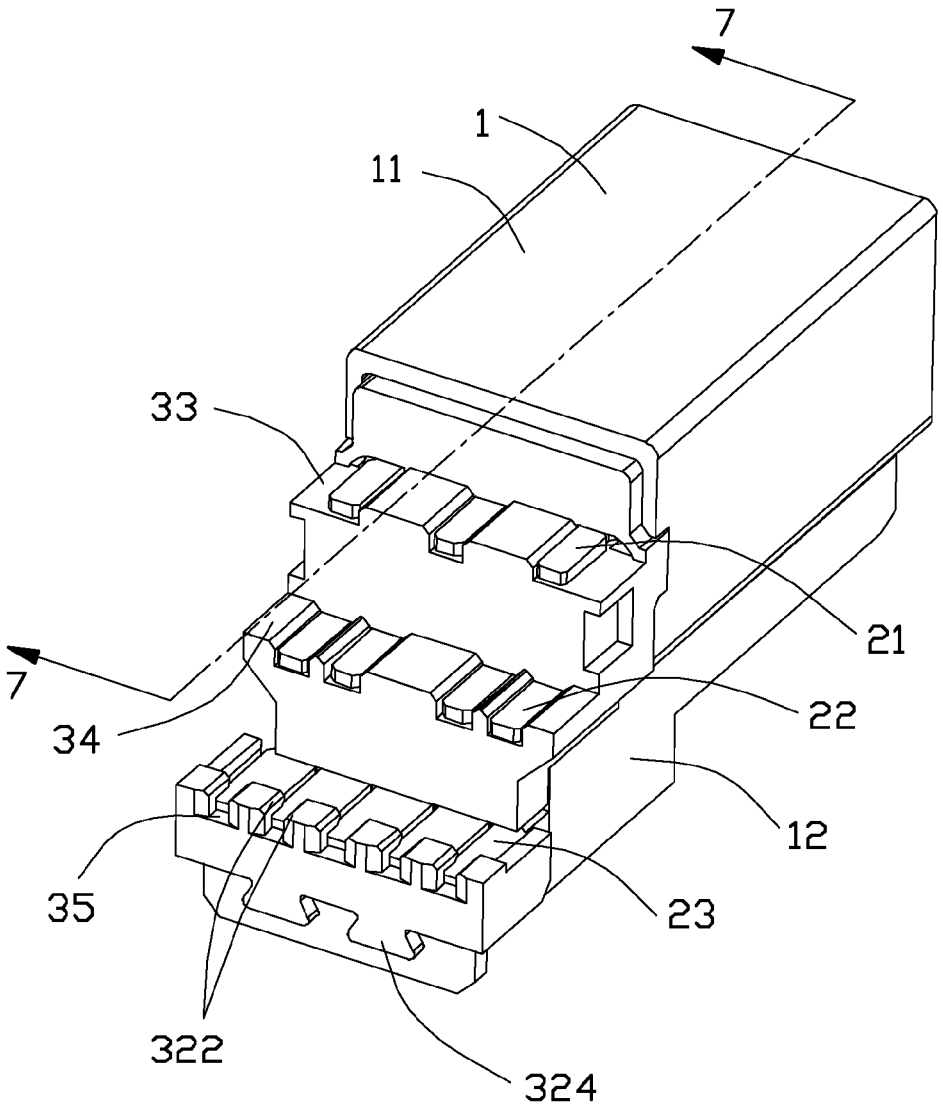
FIG. 4 is a perspective view of the spacer, the insulative body, and the terminals of the connector as shown in FIG. 1.
Figure 5:
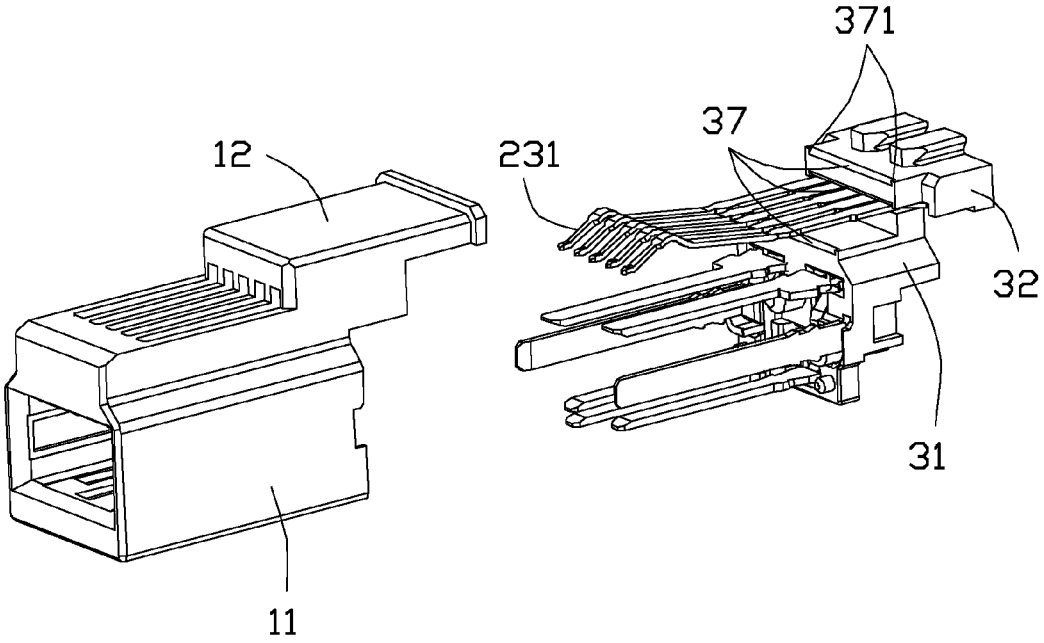
FIG. 5 is a partly exploded view of the spacer, the insulative body, and the terminals of the connector as shown in FIG. 4.
Figure 6:
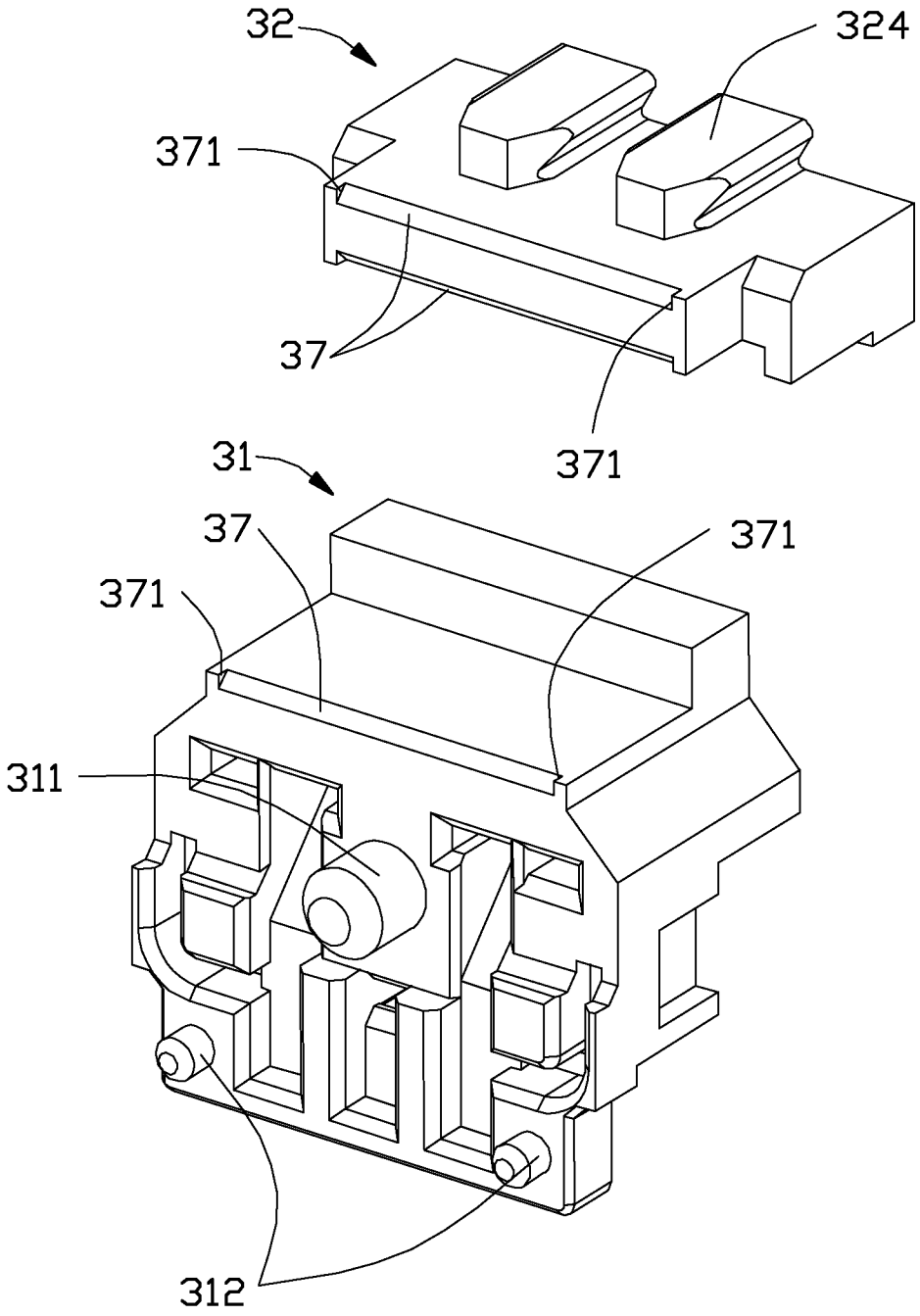
FIG. 6 is an exploded view of the spacer of the connector as shown in FIG. 1.

Referring to FIGS. 4 to 6, the spacer 3 mounted on the extending portion comprises a first spacer 31 and a second spacer 32. The first terminals 21 and the second terminals 22 are held in the first spacer 31, and the third terminals 23 are held in the second spacer 32. The spacer 3 comprises a first face 33, a second face 34, and a third face 35 spaced parallel to each other. The first face 33 and the second face 34 are disposed on the first spacer 31, and the third face 35 is disposed on the second spacer 32. The first terminals 21 are soldered on the first face 33. The second terminals 22 are soldered on the second face 34. The third terminals 23 are soldered on the third face 35. The first face 33, the second face 34, and the third face 35 are disposed in a ladder to convenient to solder the terminals 2.

The first spacer 31 comprises a first mounting post 311 mating with the first mounting hole 114 and a pair of second mounting posts 312 mating with the second mounting holes 15. A plurality of separators 321 are protruding upwardly on the third face 35 of the second spacer 32. A plurality of stopping portions 322 are disposed on the separators 321. A receiving slot 323 is formed between every two neighboring stopping portions 322 for receiving the soldering portion 232 of the third terminal 23. The stopping portion 322 limits the soldering portion 232 in the receiving slot 323 to prevent the third terminals 23 from moving upwardly and rearwardly.

Figure 7:
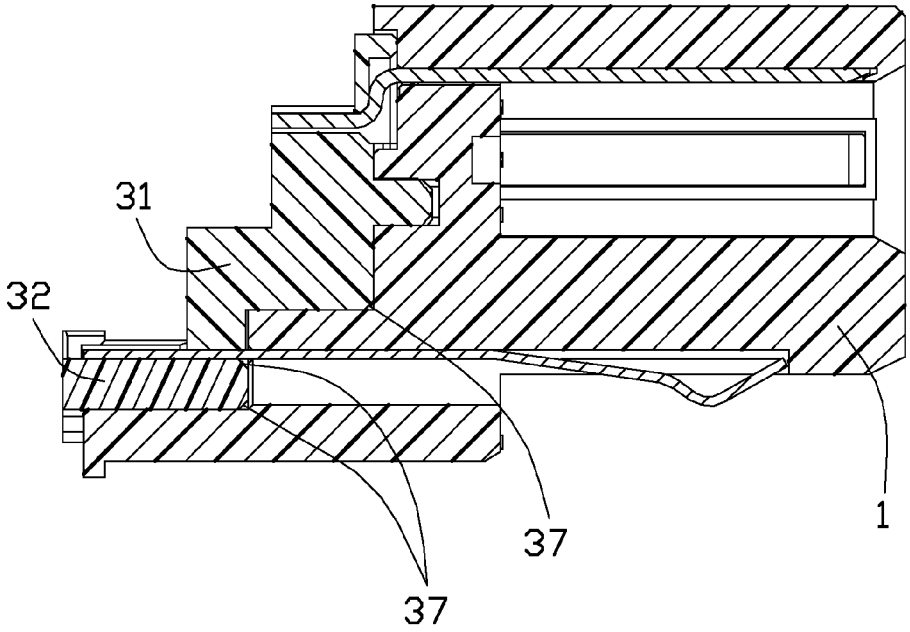
FIG. 7 is a cross-sectional view of the connector taken along line 7-7 of FIG. 4.

The second spacer 32 comprises a forth face 36 corresponding to the third face 35. The forth face 36 of the second spacer 32 comprises at least one block 324 projecting outwardly to form a fan shape. The block 324 is inserted and held in the fan slot 121 to make the second spacer 32 fixed on the insulative body 1 firmly. Referring to FIG. 7, the spacer 3 comprises a chamfer 37 on a mating position which is mating with the insulative body 1 to prevent the interference of the spacer 3 when it mounted to the insulative body 1. In this embodiment, the first spacer 31 comprises one chamfer 37 and the second spacer 32 comprises two chamfers 37. A stopping wall 371 is disposed on two sides of each chamfer 37 to prevent the molten plastic from flowing into the insulative body 1 when molded the insulative housing 6.

The metal shell 5 comprises a first shell 51 and a second shell 52 latching with the first shell 51. The first shell 51 comprises a mating portion 511 extending to the mating connector. The mating portion 511 comprises a first receiving room 512 and a second receiving room 513 with different widths. A partly portions of the first terminals 21 and the partly portions of the second terminals 22 are received in the first receiving room 512, and the partly portions of the third terminals 23 are received in the second receiving room 513.

When assembling the connector 100, the terminals 2 are inserted into the insulative body 1. The spacer 3 is mounted on the extending portion 12 of the insulative body 1. Specifically, the first post 311 of the first spacer 31 is aligned to the first hole 14 of the insulative body 1, and the second posts 312 are aligned to the second holes 15. The block 324 of the second spacer 32 is held in the fan slot 121. The terminals 2 are soldered to the core wires of the cable 200. The shielding shell 4 is mounted to enclose the spacer 3. The metal shell 5 is assembled to enclose the insulative body. The insulative housing 6 is molded to enclose the metal shell 5 at last.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector comprising:

an insulative body;

a plurality of terminals received in the insulative body;

a spacer mounted behind the insulative body; and an insulative housing molded to enclose the insulative body and the spacer; wherein the spacer comprises an intermediate chamfer at a mounting end thereof to prevent interference during mounting of the spacer to the insulative body, and a stopping wall at two opposite sides of the chamfer to prevent molten plastics from flowing into the insulative body during molding the insulative housing;

the insulative body comprises a main portion and an extending portion extending from the main portion, the extending portion having a ladder shape;

the spacer is mounted on the extending portion and comprises a first face, a second face, and a third face spaced parallel to each other, and the terminals comprise a plurality of first terminals soldered on the first face, a plurality of second terminals soldered on the second face, and a plurality of third terminals soldered on the third face, the first face, the second face, and the third face disposed in a ladder;

the spacer comprises a first spacer and a second spacer, the first face and the second face disposed on the first spacer, and the third face disposed on the second spacer;

each terminal comprises a contacting portion received in the insulative body, a soldering portion extending out of the insulative body, and a connecting portion connected the contacting portion and the soldering portion; and a plurality of stopping portions are disposed on the third face of the second spacer, and a receiving slot is formed between every two neighboring stopping portions and receives the soldering portion of the terminal, the stopping portion limiting the soldering portion in the receiving slot to prevent the terminals from moving upwardly and rearwardly.

2. The connector as recited in claim 1, wherein each of the first spacer and the second spacer comprises the chamfer and the stopping walls on two sides of the chamfer.

3. The connector as recited in claim 1, wherein the second spacer comprises a block projecting outwardly to form a fan shape, and the extending portion of the insulative body comprises a fan slot receiving the block, the block inserted and held in the fan slot to fix the second spacer on the insulative body firmly.

4. The connector as recited in claim 1, wherein the first spacer comprises at least one mounting post, and the insulative body comprises at least one mounting hole mating with the mounting post.

5. The connector as recited in claim 4, wherein the mounting post of the first spacer comprises a first mounting post and a pair of second mounting posts, and the insulative body comprises a first mounting hole and a pair of second mounting holes, the first mounting post and the second mounting posts being positioned at three points of a triangle.

6. An electrical connector comprising:

an insulative housing defining opposite first and second mating ports in a vertical direction;

a plurality of first contacts disposed in the housing with front contacting sections exposed in the first mating port and rear tail sections arranged in one row and exposed rearwardly outside of the housing;

a plurality of second contacts disposed in the housing with front contacting portions exposed in the second mating port and rear tail portions arranged in two rows and exposed rearwardly outside of the housing;

a first insulative spacer attached to a rear side of the housing and defining one row of passages to receive and expose the corresponding one row of tail section of the first contacts, respectively;

a second insulative spacer attached to the rear side of the housing and defining two rows of passageways to receive and expose the corresponding two rows of tail portions of the second contacts, respectively; wherein the first spacer and the second spacer commonly forms a three-step structure to expose said one row of tail sections and said two rows of tail portions in said same vertical direction; and the first spacer is attached to the housing via a dovetail structure extending along a front-to-back direction perpendicular to said vertical direction while the second spacer is attached to the housing via a post extending along the front-to-back direction.

7. The electrical connector as claimed in claim 6, wherein the second spacer cooperates with the first spacer to partially sandwich said one row of tail sections of the first contacts in the vertical direction.

8. The electrical connector as claimed in claim 6, wherein said first spacer is essentially located behind the second spacer, and the tail sections are located behind the tail portions in a front-to-back direction perpendicular to said vertical direction.

9. The electrical connector as claimed in claim 8, wherein the first spacer has protrusions extending in the vertical direction to be overlapped with the second spacer in the front-to-back direction so as to have the second spacer have to be assembled to the housing before the first spacer is assembled to the housing.

10. The electrical connector as claimed in claim 6, wherein the contacting portions of the second contacts are arranged in three rows.

11. An electrical connector comprising:

an insulative housing defining opposite first and second mating ports in a vertical direction;

a plurality of first contacts disposed in the housing with front contacting sections exposed in the first mating port and rear tail sections arranged in one row and exposed rearwardly outside of the housing;

a plurality of second contacts disposed in the housing with front contacting portions exposed in the second mating port and rear tail portions arranged in two rows and exposed rearwardly outside of the housing;

a spacer device attached to a rear side of the housing to regulate and expose the tail sections and tail portions; wherein the contacting sections of the first contacts are arranged in one row and the tail sections of the first contacts are arranged in one row while the contacting portions of the second contacts are arranged in three rows and the tail portions of the second contacts are arranged in two rows; wherein an amount of the one row of tail sections is five and an amount of the two rows of tail portions are three and four wherein said four tail portions are located between said five tail sections and said three tail portions in the vertical direction.

12. The electrical connector as claimed in claim 11, wherein said five tail sections are located behind the four tail portions, and said four tail portions are located behind the three tail portions in a front-to-back direction perpendicular to said vertical direction.

13. The electrical connector as claimed in claim 12, wherein said spacer device includes a first spacer regulating the five tail sections, and a second spacer regulating both said three and said four tail portions.

* * * * *